United States Patent [19]

Kuroda

[11] 3,931,425

[45] Jan. 6, 1976

[54] SIMULATED STAINED-GLASS ARTICLE AND METHOD OF MAKING THE SAME

[75] Inventor: Minoru Kuroda, Amagasaki, Japan

[73] Assignees: Nishizawa Shoji Co. Ltd, Amagasaki, Japan; Dimension Weld International Corporation, Stamford, Conn. ; part interest to each

[22] Filed: May 3, 1974

[21] Appl. No.: 466,700

[52] U.S. Cl. ..... 428/38; 52/311; 156/581

[51] Int. Cl.[2] ..... B44C 5/08

[58] Field of Search ..... 161/7, 5, 18; 52/311; 156/251, 581; 428/38, 13

[56] References Cited

UNITED STATES PATENTS

| | | | |
|---|---|---|---|
| 1,800,763 | 4/1931 | Warga | 161/5 |
| 2,710,046 | 6/1955 | Markus et al. | 156/581 |
| 2,749,640 | 6/1956 | Scott | 156/251 |
| 3,183,140 | 5/1965 | Gibson | 161/5 |
| 3,382,134 | 5/1968 | Powell | 161/5 |
| 3,533,889 | 10/1970 | Powell | 161/5 |
| 3,633,221 | 1/1972 | Addison et al. | 161/5 |

*Primary Examiner*—William E. Schulz
*Attorney, Agent, or Firm*—Michael S. Striker

[57] ABSTRACT

A top layer of transparent or translucent thermoplastic sheet material is printed on one side with a set of black color lines which form design lines that visually subdivide the one side into a plurality of portions. It is also printed on the other side with similar design lines registering with the ones on the first side, and in the portions it is printed with transparent inks of different colors. To one side of the sheet there is laminated a transparent second sheet, and the finished article has the appearance of a stained-glass object.

13 Claims, 3 Drawing Figures

SIMULATED STAINED-GLASS ARTICLE AND METHOD OF MAKING THE SAME

BACKGROUND OF THE INVENTION

The present invention is concerned with an ornamental article and a method of making the same, and more particularly with an ornamental article that simulates stained glass and with a method of making such a simultaed stain-glass article.

Articles which simulate stained glass are already known in the art. Usually, such articles involve a sheet of synthetic plastic material which has printed on one side various black lines forming design lines, and in the spaces surrounded by these lines different colors are provided by printing with transparent inks. These prior-art stained-glass simulations are very unconvincing, for several reasons. One of these reasons is the fact that there is absolutely no texture to them, that is the black design lines — which are intended to simulate the lead strips of an actual stained-glass article — are simply printed flat onto the plastic sheet material. Another problem is that the sheet material itself is completely smooth, whereas stained-glass articles usually have glass which is formed with a pebble effect or otherwise with an uneven surface.

SUMMARY OF THE INVENTION

Accordingly, it is an object of the present invention to provide an improved simulated stained-glass article which avoids the disadvantages of the prior art, and which in particular provides a much more convincing and more aesthetically pleasing simulation of actual stained glass.

An additional object of the invention is to provide a novel method of making such a simulated stained-glass article.

In keeping with the above objects, and with others which will become apparent hereafter, one feature of the invention resides in a simulated stained-glass article which, briefly stated, comprises a top layer of at least translucent synthetic plastic sheet material having two major surfaces, and a bottom layer of clear synthetic sheet material which is laminated to the top layer. First black color lines are provided on one of the major surfaces of the top layer, and registering second black color lines are provided on the other major surface thereof. These color lines form design lines on the top layer which visually subdivide the latter into a plurality of portions. Transparent inks of different colors are applied to the respective portions on at least one of the major surfaces of the top layer.

According to the invention it is desirable that along the black color lines the exposed surface of the top layer be raised, that is that ridges be formed along the black color lines, thus providing a three-dimensional effect which more closely simulates the lead strips of actual stained-glass articles than was heretofore possible.

It is also preferred according to the invention that the top layer be formed with a rough surface, for instance a pebbly effect, which can be embossed into it during production of the article, and which quite convincingly simulates the use of actual stained-glass.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
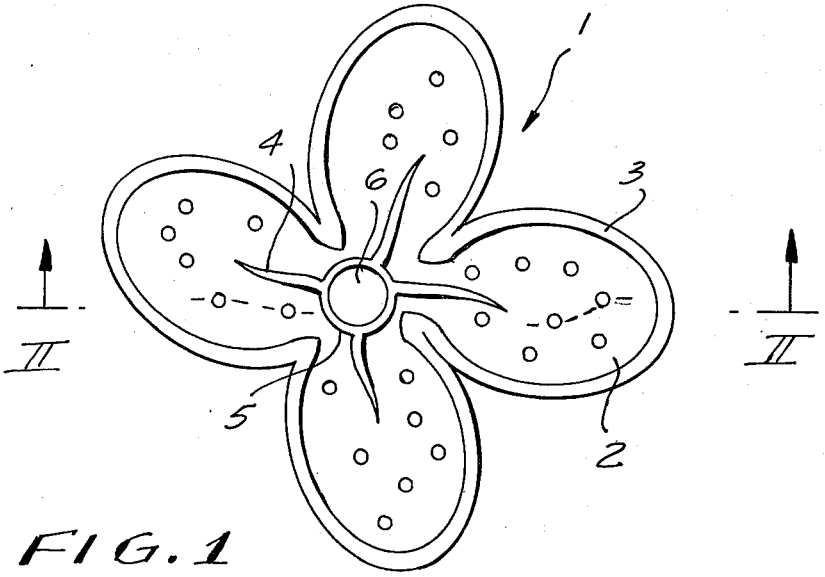
FIG. 1 is a plan view, illustrating an article according to the present invention.
Figure 2:
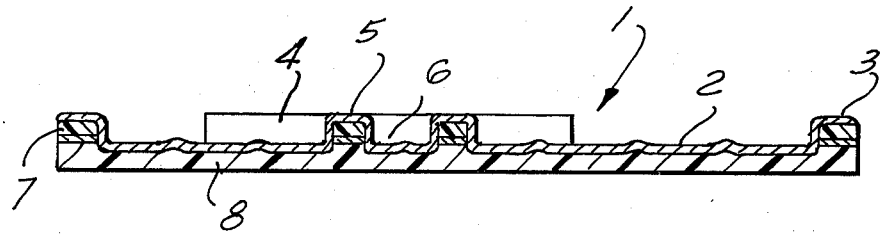
FIG. 2 is a section taken on line II—II of FIG. 1.

Referring firstly to the embodiment in FIGS. 1 and 2 it will be seen that I have illustrated therein an exemplary simulated stained-glass article according to the present invention. The article is designated in toto with reference numeral 1 and will be seen to resemble a flower. Quite evidently, this is only an exemplary configuration.

The flower 1 has a plurality of petals 2 which are surrounded by a black-color design line 3. At its center the flower 1 has a black-color design line 5 of annular configuration to simulate the flower center, and a plurality of design lines 4 simulating seeds or the like radiate from the annular design line 5. The center of the flower, surrounded by the design line 5, is designated by reference numeral 6.

As FIG. 2 shows, the article 1 is composed of two overlying layers, namely a top layer 7 and a bottom layer 8. Both of these layers are of synthetic plastic sheet material and, in this embodiment, more particularly of thermoplastic material, such as polyvinyl chloride or the like. The upper surface of the layer 7 is provided with the black-color design lines 3, 4 and 5, by means of black opaque ink. These design lines can be painted on, printed on as is more usual, or applied in any desired manner. The bottom surface of the layer 7 is also provided with the same design lines 3, 4 and 5, in such a manner that they register with those on the top surface of the layer 7. The purpose of providing the black color design lines on both sides is to assure that the black color will act as the final trapping color on both sides, to provide the proper effect when the article is viewed from either side. The upper surface of the top layer 7 is also provided with the illustrated pebbly effect, but of course a different roughening effect can also be provided, for instance by means of simulated crackling lines. Within the areas surrounded by the design lines 3, 4 and 5, that is on the petals 2 and at the center 6, transparent inks of various different colors are provided, by painting them on, by printing them on or in any desired manner. Thus, one of the petals might be red, one might be green, one might be yellow and one might be blue, and the center might be mauve, or of course any desired color can be employed.

The inks required for the design lines and the transparent inks required for the colors which are to permit the passage of light are well known in the art. For instance, there are special inks available commercially for printing onto polyvinyl chloride sheet material, and these are well suited for this purpose.

Laminated to the bottom surface of the top layer 7 is the bottom layer 8 which is a layer of clear — i.e. transparent — plastic sheet material, for instance polyvinyl chloride as mentioned above.

Figure 3:
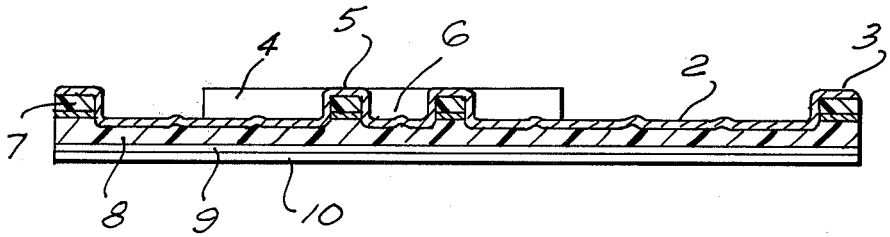
FIG. 3 is a section similar to that of FIG. 2, but illustrating a further embodiment of the invention.

FIG. 3 shows that the article 1 — which in FIG. 3 is identical with the one shown in FIGS. 1 and 2 — can be further provided on the underside of the bottom layer 8 with an adhesive layer 9 of the type that is so widely used in self-adhering labels or other objects, and over which a layer 10 of release paper or the like is applied, to prevent the layer 9 from adhering to any objects until it is desired to use the article. At that time the layer 10 is peeled off in the manner conventional with self-adhesive labels or the like, and the articles can then be affixed to a support, for instance to the glass of a window, so that light can pass through it. Evidently, the article could be also applied to a lampshade or the like.

To produce the article 1, the design lines 3, 4 and 5 are applied to it by painting, printing or the like, as already pointed out earlier, and similarly the transparent colors are applied to the petals and the center 6. Thereupon the layer 7 is superimposed upon the layer 8, or vice versa, and the two layers are then placed into a high frequency welding machine which is also known per se, and which has a support and a die acting as one of the electrodes. The die is formed with projections configurated to produce the desired three-dimensional effect on the article 1. The use of such a high frequency welding machine, and the use of a die — which latter may be produced by photoengraving on metal, or else by means of silicone-rubber molding, both techniques which are known per se in the art — is already known, and is for instance described in my copending application Ser. No. 293,376, now abandoned to which reference may be had. Those areas of the die which will contact the surface area of the petals 2 and the area 6, may be provided with appropriate embossing which will form the pebble effect shown in the drawing. Those areas of the die which are to be located opposite the design lines 3, 4 and 5, can be slightly recessed so that, when the die and the support are moved together and thus exert pressure upon the layers 7 and 8 while simultaneously heating the latter in accordance with established practice to the point where their material briefly becomes liquid or near-liquid, some of the material from the petals 2 and the center 6 is squeezed out into the recesses which overlie the design lines 3, 4 and 5, so that along these design lines an increased material thickness will be obtained, whereas the thickness of the petals 2 and the center 6 will be less than that along the design lines 3, 4 and 5. Thus, at the upper surface of the top layer 7, the design lines 3, 4 and 5 will appear as raised ridges and provide quite a convincing simulation of the lead strips in actual stained-glass articles.

High frequency welding machines are known and commercially available, and therefore require no detailed description. Depending upon the size of the stained-glass article to be produced, the capacity of the machine may be as high as 35 KW or even 50 KW or higher. The technique of laminating the layers 7 and 8 together is not novel in itself, although it has been described above, having been set forth in the prior art, including my above-mentioned copending application Ser. No. 293,376.

It will be appreciated that many variations will offer themselves to those having skill in the art. In particular, the designs that can be produced in simulated stained-glass articles according to the present invention, can of course vary widely. Also, materials other than polyvinyl chloride might be used, and in fact other thermoplastics such as polyethylene could be employed. It is also evident that if desired a layer corresponding to the layer 8 could also be superimposed upon the layer 7, so that the latter would then be sandwiched between two of the layers 8. In the latter case the raised ridges corresponding to the design lines 3, 4 and 5 would then of course be formed in the superimposed layer 8, rather than in the layer 7.

It will be understood that each of the elements described above, or two or more together, may also find a useful application in other types of constructions differing from the types described above.

While the invention has been illustrated and described as embodied in a simulated stained-glass article, it is not intended to be limited to the details show, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

1. A simulated stained-glass article which has a realistic appearance when viewed from either side, comprising a top layer of at least translucent synthetic plastic sheet material having two opposite major surfaces; a bottom layer of clear synthetic plastic sheet material laminated to one of said surfaces of said top layer; raised ridges on the other of said major surfaces and forming design lines which visually subdivide said top layer into a plurality of portions; first black color lines substantially coextensive with said ridges at said other major surface; second black color lines on said one major surface and each registering with one of said first black color lines; and a plurality of transparent inks of different colors applied to the respective portions on at least one of said major surfaces.

2. An article as defined in claim 1, wherein at least said top layer is polyvinyl chloride.

3. An article as defined in claim 1, wherein both of said layers are polyvinyl chloride.

4. An article as defined in claim 1, wherein said layers are of thermoplastic material and are thermally laminated to one another.

5. An article as defined in claim 1, said bottom layer having a side facing away from said top layer; and further comprising a layer of adhesive material on said side for affixing said article to a support.

6. An article as defined in claim 5, wherein said adhesive material is an actively adhesive material; and further comprising a layer of release material covering said layer of adhesive material to protect the same until the time of use.

7. An article as defined in claim 1, wherein at least one of said major surfaces is embossed to simulate rough glass.

8. A method of making a simulated stained-glass article, comprising the steps of forming one of two major surfaces of an at least translucent synthetic plastic sheet with raised ridges which subdivide said one major surface into a plurality of portions; applying first black color lines to said raised ridges at said one major surface; applying different-colored transparent inks to the respective portions; applying to the other of said major surfaces second black color lines which each register with one of the first black color lines of said one major surface; and laminating a sheet of clear synthetic plastic sheet material to the first-mentioned sheet.

9. A method as defined in claim 8, wherein said sheets are thermoplastic, and wherein the step of laminating comprises heat-welding said sheets together.

10. A method as defined in claim 9, wherein the step of laminating comprises applying pressure to said sheets while heat-welding them together.

11. A method as defined in claim 10, wherein said pressure is applied at least at said portions.

12. A method as defined in claim 8; and further comprising the step of applying a layer of adhesive to a side of said clear plastic sheet which faces away from said first-mentioned sheet.

13. A method as defined in claim 12, wherein said adhesive is an actively adhesive material; and further comprising the step of applying a release-material sheet over said adhesive to protect the latter until the time of use.

* * * * *